United States Patent [19]

Burson

[11] 4,207,698

[45] Jun. 17, 1980

[54] DEVICE FOR LOADING MUZZLE LOADING RIFLES AND METHOD OF PREPARING THE DEVICE

[76] Inventor: James Burson, Rte. 2 Box 614, Gresham, Oreg. 97030

[21] Appl. No.: 877,170

[22] Filed: Feb. 13, 1978

[51] Int. Cl.[2] ..... F42B 39/04; F41C 27/00

[52] U.S. Cl. ..... 42/90

[58] Field of Search ..... 42/90; 86/23

[56] References Cited

U.S. PATENT DOCUMENTS

| | | | |
|---|---|---|---|
| 243,250 | 6/1881 | Hall | 42/90 |
| 3,747,252 | 7/1973 | Walker | 42/90 |
| 4,050,175 | 9/1977 | Mulinix | 42/90 |
| 4,112,606 | 9/1978 | Griffin | 42/90 |

OTHER PUBLICATIONS

"Load-N-Cap Speed Loader", *The American Rifleman,* vol. 124, No. 11, p. 43; Nov. 1976.

*Primary Examiner*—Charles T. Jordan
*Attorney, Agent, or Firm*—Andrew A. Steiner

[57] ABSTRACT

The invention relates to a capsule having a complete load for a muzzle loading rifle.

The capsule comprises of a first tube containing the preweighed powder and a second tube containing the presized and patched ball or any desired projectile and the primer. The second tube is detachably connected to the first tube. The invention also discloses the method of making the said capsule.

5 Claims, 8 Drawing Figures

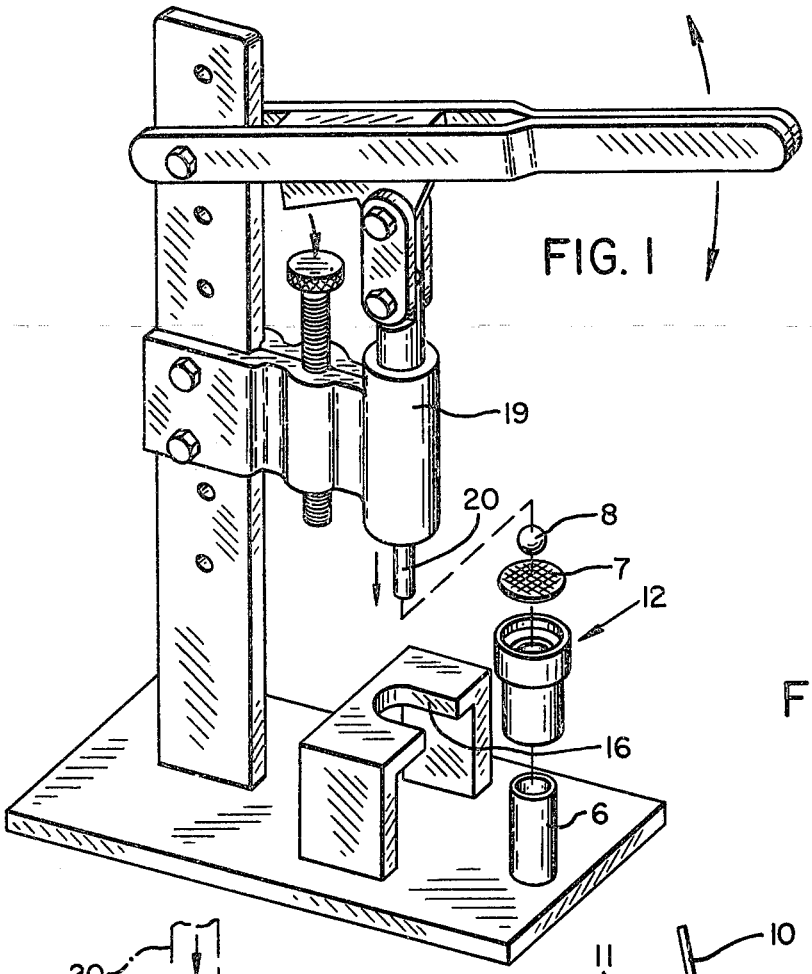
FIG. 1
FIG. 5
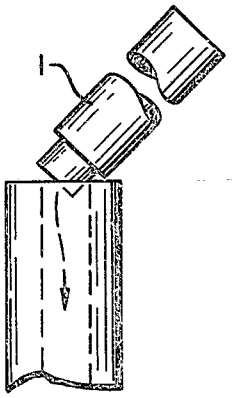
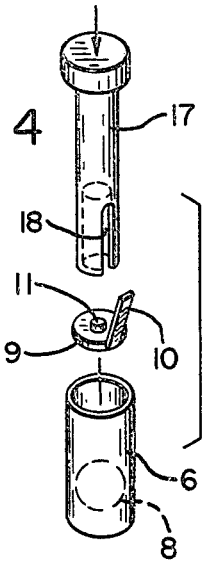
FIG. 4
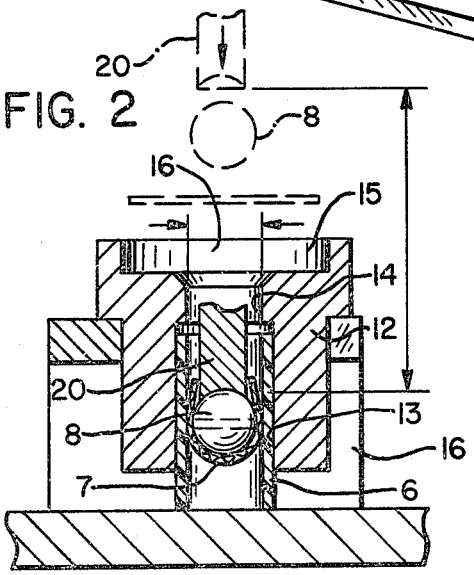
FIG. 2
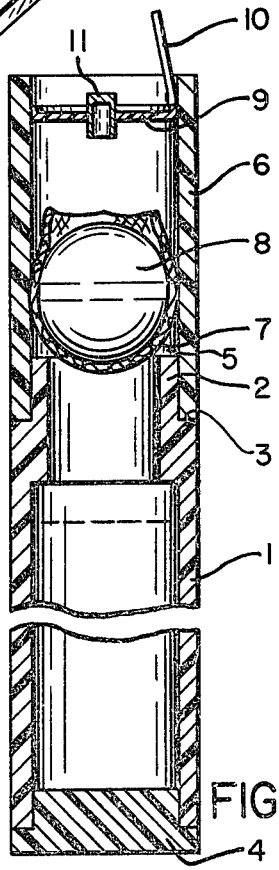
FIG. 3
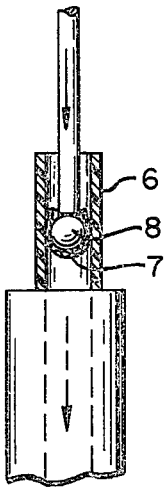
FIG. 6
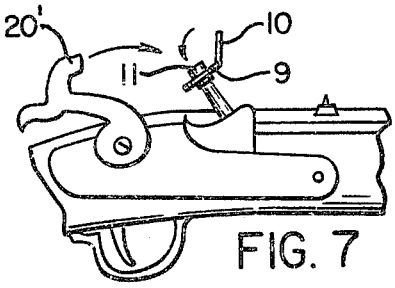
FIG. 7

DEVICE FOR LOADING MUZZLE LOADING RIFLES AND METHOD OF PREPARING THE DEVICE

BACKGROUND AND SUMMARY

The prior art as shown in the patent cited, U.S. Pat. No. 4,050,175, Mulinix, provides a single tubular container having the powder, patch and ball in one convenient place; however it provides no other advantage in the loading of the rifle; on the contrary, the patch and ball, which is somewhat larger than the bore, has to be loaded into the rifle with considerable force and in addition has to travel through a long tube which during the loading must be perfectly aligned with the bore of the rifle, following the loading the operator has to get the primer from a different place.

OBJECT AND ADVANTAGE

My device contains the projectile, for example the patched, presized ball in a short tube, having means of removably attaching it to the powder carrying tube. The patched ball contained in the short tube has to be moved only a short distance within the tube before entering the bore. Furthermore the primer cap, placed in a disc, is handily located at the top of the projectile carrying tube. The disc holding the cap has the exact size of the said tube and therefore prevents moisture or any foreign matter entering into the unit.

DESCRIPTION OF THE DRAWING

FIG. 1 is a perspective view of a press, equipped with a die guide, a die, and shows the projectile carrying tube.

FIG. 2 is a sectional view of the die positioned in the die guide, holding the inserted patch and ball.

FIG. 3 is a cross-section of the completely assembled device.

FIG. 4 is a perspective view of the primer and the primer placing tool, showing the process of the insertion of the primer into the tube.

FIG. 5 is a view of the powder carrying tube in the process of pouring the powder into the bore.

FIG. 6 is an elevational cross-section of the projectile carrying tube in the process of loading the rifle.

FIG. 7 shows the primer in position for ignition by the hammer of the weapon.

DETAILED DESCRIPTION

Figure 8:
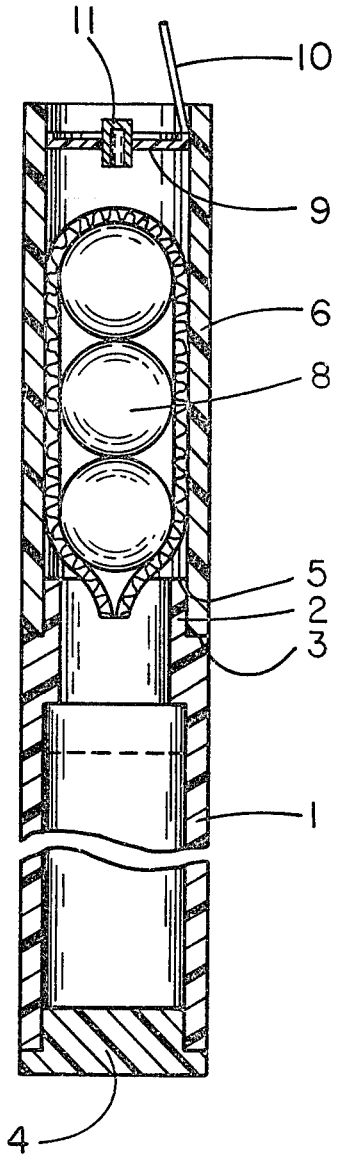
FIG. 8 is a cross-section of the assembled device showing three projectiles.

Referring now to the drawings the device comprises of a first powder carrying tube 1 and a second projectile carrying tube 6 detachably connected to the first tube 1 and a disc 9, in the disc 9 the primer 11 is inserted and the disc is placed into the top opening of the second tube 6.

The first tube 1 has a closed bottom 4, the top 5 of the said tube is open. The first tube 1 has a narrowed neck 2 and shoulder 3. The outside circumference of the said neck 2 fits the inside circumference of the second tube 6 hereinafter described.

The second tube 6 which is open at both ends carries the projectile which in the drawing is illustrated by a presized ball 8 and a centered lubricated patch 7; however other projectiles are equally adaptable, for example a conical bullet, shots or flares. The projectile is positioned toward the bottom of the tube 6 which is to be connected to the first tube 1. The second tube 6 is closed at its top with a disc 9, provided with a handle 10 holding at its center the primer 11.

The projectile carrying tube 6 fits over the neck 2 of the powder carrying tube 1 and rests on the shoulder 3, providing an easily detachable connection.

However other methods of detachably connecting the tubes will be obvious to those skilled in the art.

The projectile provides a closure for the powder carrying tube and the primer disc closes the whole device making it watertight and dirt-proof. In operation the hunter detaches the projectile carrying tube 6 from the powder carrying tube 1, pours the powder into the rifle, removes the primer disc 9 and with little force inserts the patched, sized ball into the bore and puts in the disc containing primer to its place.

The device is usable for a muzzle loading rifle or single shot muzzle loading pistol. The preferred material for the tubes and disc is any rigid plastic.

METHOD OF PREPARING THE DEVICE

The process for making the device comprises of the following steps: The projectile carrying tube 6 is placed in the lower portion 13 of a die 12, the projectile is placed on the top 16 of the die 12. In case the projectile is a patched ball the lubricated patch is placed at the top of the die 16, the top is the exact size of the patch and the ball is placed on the center of the patch. Means are provided for applying downward vertical pressure to the projectile, forcing it through the die 12 into the tube 6. The tube 6 is closed by the primer disc 9 with a closing tool 17. The assembled tube 6 is connected to the first tube 1 by pushing it down on the narrow neck of the first tube. The die 12 is designed with a larger diameter at its lower portion 13 to accommodate the tube 6 and a smaller diameter 14 at its upper portion for sizing the projectile.

The die is placed in a die holder 16 holding it in a fixed position during loading.

The disc 9 is inserted in the tube 6 by a tool 17 provided with a slit 18 to accommodate the handle 10, and fitting the tube.

The preferred embodiment of the pressure means for the insertion of the projectile into the tube 6 comprises a pressure rod 20 vertically movable and operatively connected to a press.

I claim:

1. An apparatus for loading muzzle loading weapons comprizing;

a primer holding disc;

a first powder carrying tube closed at one end;

a second open ended projectile carrying tube detachably connected to the first tube and the said open end is optionally closable with the primer holding disc.

2. An apparatus as described in claim 1, where the first tube at its open end has a narrowed neck and shoulder, fitting the inside circumference of the second tube and adapted for connecting the tubes.

3. An apparatus as described in claim 1 where the projectile is a ball presized to a diameter less than the bore diameter of the weapon operatively associated with a lubricated patch.

4. An apparatus as described in claim 1 where the projectile comprises three flares.

5. An apparatus described in claim 1 where the primer holding disc is adapted for closing the second tube.

* * * * *